US007121058B2

(12) United States Patent
Palsson et al.

(10) Patent No.: US 7,121,058 B2
(45) **Date of Patent: *Oct. 17, 2006**

(54) BUILDING PANELS

(75) Inventors: Jorgen Palsson, Landskrona (SE); Ake Sjöberg, Lund (SE)

(73) Assignee: Pergo (Europe) AB, Trelleborg (SE)

( * ) Notice: Subject to any disclaimer, the term of this patent is extended or adjusted under 35 U.S.C. 154(b) by 288 days.

This patent is subject to a terminal disclaimer.

(21) Appl. No.: 10/286,982

(22) Filed: Nov. 4, 2002

(65) Prior Publication Data

US 2003/0079820 A1 May 1, 2003

Related U.S. Application Data

(63) Continuation-in-part of application No. 10/242,674, filed on Sep. 13, 2002, and a continuation-in-part of application No. 09/988,014, filed on Nov. 16, 2001, now abandoned, and a continuation-in-part of application No. 09/672,076, filed on Sep. 29, 2000, now Pat. No. 6,591,568.

(30) Foreign Application Priority Data

Mar. 31, 2000 (SE) ..... 0001149

(51) Int. Cl.
*E04B 2/08* (2006.01)

(52) U.S. Cl. ..... 52/592.2; 52/177; 52/591.1; 52/273

(58) Field of Classification Search ..... 52/589.1, 52/591.1, 592.1–592.3, 273, 177
See application file for complete search history.

(56) References Cited

U.S. PATENT DOCUMENTS 213,740 A * 4/1879 Conner ..... 52/503

(Continued)

FOREIGN PATENT DOCUMENTS

BE 1010487 12/1999

(Continued)

OTHER PUBLICATIONS

Pending U.S. Appl. No. 09/672,077.

(Continued)

*Primary Examiner*—Carl D. Friedman
*Assistant Examiner*—Yvonne M. Horton
(74) *Attorney, Agent, or Firm*—Stevens, Davis, Miller & Mosher, L.L.P.

(57) ABSTRACT

Flooring material comprising sheet-shaped floor elements with a mainly square or rectangular shape. The floor elements are provided with edges, a lower side and an upper decorative layer. The floor elements are intended to be joined by means of joining members. The floor elements are provided with male joining members on a first edge while a second edge of the floor elements are provided with a female joining member. The male joining member is provided with a tongue and a lower side groove while the female joining member is provided with a groove and a cheek, the cheek being provided with a lip. The floor elements are provided with a male vertical assembly joining member on a third edge while a fourth, opposite, edge is provided with female vertical assembly joining member. The floor elements are alternatively provided with a male vertical assembly joining member on a third edge while a fourth, opposite, edge also is provided with male vertical assembly joining member. Adjacent male vertical assembly joining members are hereby joined by means of a separate vertical assembly joining profile. Two adjacent edges of a floor element can hereby, at the same time, and in the same turning motion, be joined with a floor element adjacent to the first edge and a floor element adjacent to the third or fourth edge.

16 Claims, 6 Drawing Sheets

(56) References Cited

U.S. PATENT DOCUMENTS

| | | | | | |
|---|---|---|---|---|---|
| 714,987 | A | * | 12/1902 | Wolfe | 52/578 |
| 1,823,039 | A | * | 9/1931 | Gruner | 52/592.4 |
| 2,004,193 | A | | 6/1935 | Cherry | |
| 2,405,602 | A | | 8/1946 | Nugent | |
| 2,740,167 | A | | 4/1956 | Rowley | |
| 3,257,225 | A | | 6/1966 | Marotta et al. | |
| 3,479,784 | A | | 11/1969 | Massagli | |
| 3,496,119 | A | | 2/1970 | Weller et al. | |
| 3,553,919 | A | | 1/1971 | Omholt | |
| 3,720,027 | A | | 3/1973 | Christensen | |
| 3,798,111 | A | | 3/1974 | Lane et al. | |
| 3,807,113 | A | | 4/1974 | Turner | |
| 3,859,000 | A | * | 1/1975 | Webster | 404/41 |
| 3,921,312 | A | * | 11/1975 | Fuller | 434/96 |
| 4,099,358 | A | * | 7/1978 | Compaan | 52/588.1 |
| 4,426,820 | A | * | 1/1984 | Terbrack et al. | 52/594 |
| 4,449,346 | A | | 5/1984 | Tremblay | |
| 4,844,972 | A | | 7/1989 | Tedeschi et al. | |
| 4,905,442 | A | * | 3/1990 | Daniels | 52/588.1 |
| 4,940,503 | A | | 7/1990 | Lindgren et al. | |
| 5,148,850 | A | | 9/1992 | Urbanick | |
| 5,216,861 | A | | 6/1993 | Meyerson | |
| 5,295,341 | A | * | 3/1994 | Kajiwara | 52/586.2 |
| 5,325,649 | A | | 7/1994 | Kajiwara | |
| 5,344,700 | A | | 9/1994 | McGath et al. | |
| 5,348,778 | A | | 9/1994 | Knipp et al. | |
| 5,502,939 | A | | 4/1996 | Zadok et al. | |
| 5,630,304 | A | | 5/1997 | Austin | |
| 5,706,621 | A | | 1/1998 | Pervan | |
| 5,797,237 | A | | 8/1998 | Finkell, Jr. | |
| 5,860,267 | A | | 1/1999 | Pervan | |
| 5,907,934 | A | | 6/1999 | Austin | |
| 6,006,486 | A | * | 12/1999 | Moriau et al. | 52/589.1 |
| 6,023,907 | A | | 2/2000 | Pervan | |
| 6,094,882 | A | | 8/2000 | Pervan | |
| 6,101,778 | A | | 8/2000 | Martensson | |
| 6,182,410 | B1 | | 2/2001 | Pervan | |
| 6,205,639 | B1 | | 3/2001 | Pervan | |
| 6,209,278 | B1 | | 4/2001 | Tychsen | |
| 6,216,409 | B1 | * | 4/2001 | Roy et al. | 52/589.1 |
| 6,314,701 | B1 | | 11/2001 | Meyerson | |
| 6,324,803 | B1 | | 12/2001 | Pervan | |
| 6,324,809 | B1 | * | 12/2001 | Nelson | 52/592.2 |
| 6,345,481 | B1 | * | 2/2002 | Nelson | 52/592.2 |
| 6,363,678 | B1 | * | 4/2002 | Shuler | 52/656.9 |
| 6,397,547 | B1 | | 6/2002 | Martensson | |
| 6,418,683 | B1 | | 7/2002 | Martensson et al. | |
| 6,421,970 | B1 | | 7/2002 | Martensson et al. | |
| 6,438,919 | B1 | | 8/2002 | Knauseder | |
| 6,490,836 | B1 | * | 12/2002 | Moriau et al. | 52/589.1 |
| 6,505,452 | B1 | * | 1/2003 | Hannig et al. | 52/582.1 |
| 6,536,178 | B1 | * | 3/2003 | Palsson et al. | 52/589.1 |
| 6,546,691 | B1 | * | 4/2003 | Leopolder | 52/747.1 |
| 6,551,007 | B1 | * | 4/2003 | Lichtenberg et al. | 403/270 |
| 6,591,568 | B1 | * | 7/2003 | Palsson | 52/592.2 |
| 6,601,359 | B1 | * | 8/2003 | Olofosson | 52/588.1 |
| 2002/0046526 | A1 | | 4/2002 | Knauseder | |

FOREIGN PATENT DOCUMENTS

| | | |
|---|---|---|
| CA | 991373 | 6/1976 |
| DE | 2159042 | 6/1973 |
| DE | 2238660 | 2/1974 |
| DE | 3343601 | 6/1985 |
| GB | 812671 | 4/1959 |
| GB | 1348272 | 3/1974 |
| GB | 1430423 | 3/1976 |
| GB | 2256023 | 11/1992 |
| JP | 3169967 | 7/1991 |
| SE | 501014 | 10/1994 |
| SE | 502994 | 9/1996 |
| WO | 9313280 | 7/1993 |
| WO | 9747834 | 12/1997 |
| WO | 9966151 | 12/1999 |
| WO | 0063510 | 10/2000 |

OTHER PUBLICATIONS

Pending U.S. Appl. No. 09/988,014.
Pending U.S. Appl. No. 09/770,395.
Pending U.S. Appl. No. 10/158,945.
Pending U.S. Appl. No. 09/672,076.

* cited by examiner

BUILDING PANELS

CROSS-REFERENCE TO RELATED APPLICATIONS

This application is a Continuation-In-Part of U.S. application Ser. No. 09/672,076, filed Sep. 29, 2000, now U.S. Pat. No. 6,591,568, and a Continuation-In-Part of U.S. application Ser. No. 09/988,014, filed Nov. 16, 2001, now abandoned, and a Continuation-In-Part of U.S. application Ser. No. 10/242,674, filed Sep. 13, 2002, and additionally claims priority from Swedish Application No. 0001149-4, filed Mar. 31, 2000, the entire disclosures of which are incorporated herein by reference in their entirety.

BACKGROUND

1. Field of the Invention

The present invention relates to a flooring material comprising sheet-shaped floor elements which are joined by means of joining members.

2. Background

Prefabricated floor boards provided with tongue and groove at the edges are quite common nowadays. These can be installed by the average handy man as they are very easy to install. Such floors can, for example, be constituted of solid wood, or of wood particles consolidated by use of a binder including fibre board, such as high or medium density fibre board (HDF or MDF), particle board, chip board, oriented strand board (OSB) or any other construction comprising particles of wood bonded together with a binder. These are most often provided with a surface layer such as lacquer, or some kind of laminate. The boards are most often installed by being glued via tongue and groove. The most common types of tongue and groove are however burdened with the disadvantage to form gaps of varying width between the floor boards in cases where the installer hasn't been thorough enough. Dirt will easily collect in such gaps. Moisture will furthermore enter the gaps which will cause the core to expand in cases where it is made of wood, fibre board or particle board, which usually is the case. The expansion will cause the surface layer to rise closest to the edges of the joint which radically reduces the useful life of the floor since the surface layer will be exposed to an exceptional wear. Different types of tensioning devices, forcing the floor boards together during installation can be used to avoid such gaps. This operation is however more or less awkward. It is therefore desirable to achieve a joint which is self-guiding and thereby automatically finds the correct position. Such a joint would also be possible to utilize in floors where no glue is to be used.

Such a joint is known through WO 94/26999 (herein incorporated by reference in its entirety) which deals with a system to join two floor boards. The floor boards are provided with a locking device at the rear sides. In one embodiment the floor boards are provided with profiles on the lower side at a first long side and short side. These profiles, which extends outside the floor board itself, is provided with an upwards directed lip which fits into grooves on the lower side of a corresponding floor board. These grooves are arranged on the second short side and long side of this floor board. The floor boards are furthermore provided with a traditional tongue and groove on the edges. The intentions are that the profiles shall bend downwards and then to snap back into the groove when assembled. The profiles are integrated with the floor boards through folding or alternatively, through gluing.

According to WO 94/26999, the floor boards may be joined by turning or prizing it into position with the long side edge as a pivot point. It is then necessary to slide the floor board longitudinally so that it snaps into the floor board previously installed in the same row. A play is essential in order to achieve that. This play seems to be marked Δ in the figures. A tolerance of ±2 mm is mentioned in the application. Such a play will naturally cause undesired gaps between the floor boards. Dirt and moisture can penetrate into these gaps.

It is also known through WO 97/47834 (herein incorporated by reference in its entirety) to manufacture a joint where the floor boards are joined by turning or prizing it into position with the long side edge as a pivot point. According to this invention a traditional tongue has been provided with heel on the lower side. The heel has a counterpart in a recess in the groove of the opposite side of the floor board. The lower cheek of the groove will be bent away during the assembly and will then snap back when the floor board is in the correct position. The snap-joining parts, i.e. the tongue and groove, is in opposite to the invention according to WO 94/26999 above, where they are constituted by separate parts, seems to be manufactured monolithically from the core of the floor board. WO 97/47834 does also show how the tongue and groove with heels and recesses according to the invention is tooled by means of cutting machining. This invention does also have the disadvantage that the best mode of joining floor boards includes longitudinal sliding for joining the short sides of the floor boards, which also here will require a play which will cause unwanted gaps between the floor boards. Dirt and moisture can penetrate into these gaps.

SUMMARY OF THE INVENTION

It is, through the present invention, made possible to solve the above mentioned problems whereby a floor element which can be assembled without having to be slid along already assembled floor elements has been achieved. Accordingly, the invention relates to a flooring material comprising sheet-shaped floor elements with a mainly square or rectangular shape. The floor elements are provided with edges, a lower side and an upper decorative layer. The floor elements are intended to be joined by means of joining members. The invention is characterised in that;

a) The floor elements are provided with male joining members on a first edge while a second, opposite, edge of the floor elements are provided with a female joining member. The male joining member is provided with a tongue and a lower side groove. The female joining member is provided with a groove and a cheek, the cheek being provided with a lip. The floor elements are intended to mainly be joined together by tilting the floor element to be joined with an already installed floor element or a row of already installed floor elements, with the male joining member of the floor element angled downwards and that the first edge is allowed to be mainly parallel to the second edge of the already installed floor element or elements. The tongue of the tilted floor element is then inserted into the groove of the female joining member of the already installed floor element or elements. The tilted floor element is then turned downwards, with its lower edge as a pivot axis, so that the lip eventually snaps into the lower side groove where the decorative upper layer of the floor elements are mainly parallel.

b) The floor elements are moreover provided with a male vertical assembly joining member on a third edge while a fourth edge is provided with female vertical assembly joining member. The fourth edge is arranged on a side opposite to the third edge.

c) The floor elements are alternatively provided with a male vertical assembly joining member on a third edge, while a fourth edge also is provided with male vertical assembly joining member. The fourth edge is arranged on a side opposite to the third edge. Adjacent male vertical assembly joining members are thereby joined by means of a separate vertical assembly joining profile. Two adjacent edges of a floor element can hereby be joined with a floor element adjacent to the first edge and a floor element adjacent to the third or fourth edge at the same time, and in the same turning motion.

The force needed to overcome the static friction along the joint between two completely assembled male and female joining members is preferably larger than 10N per meter of joint length, suitably larger than 100N per meter of joint length.

According to one embodiment of the invention, the floor elements are provided with male vertical assembly joining members on a third edge and provided with female vertical assembly joining members on a fourth edge. The male vertical assembly joining members are provided with mainly vertical lower cheek surfaces arranged parallel to the closest edge. The lower cheek surfaces are intended to interact with mainly vertical upper cheek surfaces arranged on the female vertical assembly joining members so that two joined adjacent floor elements are locked against each other in a horizontal direction. The male and female vertical assembly joining members are provided with one or more snapping hooks with matching under cuts which by being provided with mainly horizontal locking surfaces limits the vertical movement between two joined adjacent floor elements.

The floor elements may alternatively be provided with male vertical assembly joining members on both a third and a fourth edge. These edges are then snap joined by means of a vertical assembly profile which on both sides of a longitudinal symmetry line is designed as a female vertical assembly joining member according to the description above. Two joined adjacent floor elements are locked to each other in a horizontal direction via the vertical assembly profile while, at the same time, vertical movement between two joined adjacent floor elements is limited.

The joint between a third and a fourth edge of two joined floor elements preferably comprises contact surfaces which are constituted by the horizontal locking surfaces of the under cuts and hooks, the mainly vertical upper cheek surfaces and lower cheek surfaces as well as upper mating surfaces.

The joint between two joined floor elements suitably also comprises cavities.

According to one embodiment of the invention the snapping hook is constituted by a separate spring part which is placed in a cavity. Alternatively the undercut is constituted by a separate spring part which is placed in a cavity. The spring part is suitably constituted by an extruded thermoplastic profile, a profile of thermosetting resin or an extruded metal profile.

The vertical assembly joining profiles are suitably shaped as extended profiles which suitably are manufactured through extrusion which is a well known and rational method. The vertical assembly joining profiles are suitably shaped as extended lengths or rolls which can be cut to the desired length. The length of the vertical assembly joining profiles considerably exceeds the length of a floor element, before being cut. The lateral joints of the floor will only need shorter pieces of vertical assembly joining profiles which are positioned as each new floor board is introduced to a row. Vertical assembly joining profiles according to the present invention may be manufactured of a number of different materials and manufacturing methods. Among the most suited can, however, be mentioned injection moulding and extrusion. Suitable materials are thermoplastic materials such as polyolefins, polystyrene, polyvinyl chloride or acrylnitrile-butadiene-styrene copolymer. These may suitably be filled with, for example, wood powder or lime in order to increase the rigidity but also to increase the adhesion when glue is used. It is also possible to mill a vertical assembly joining profile from a material such as wood, fibre board or particle board.

The flooring material including the floor boards and joining profiles above is most suited when installing floors where it isn't desired to use glue. It is, however, possible to use glue or twin-faced adhesive tape in order to make the installation irreversibly permanent. The glue or tape is then suitably applied on, or in connection to, possible cavities or faces below the upper mating surfaces.

BRIEF DESCRIPTION OF THE DRAWINGS

The invention is described further in connection to enclosed figures showing different embodiments of a flooring material whereby.

DETAILED DESCRIPTION OF THE INVENTION

Figure 1:
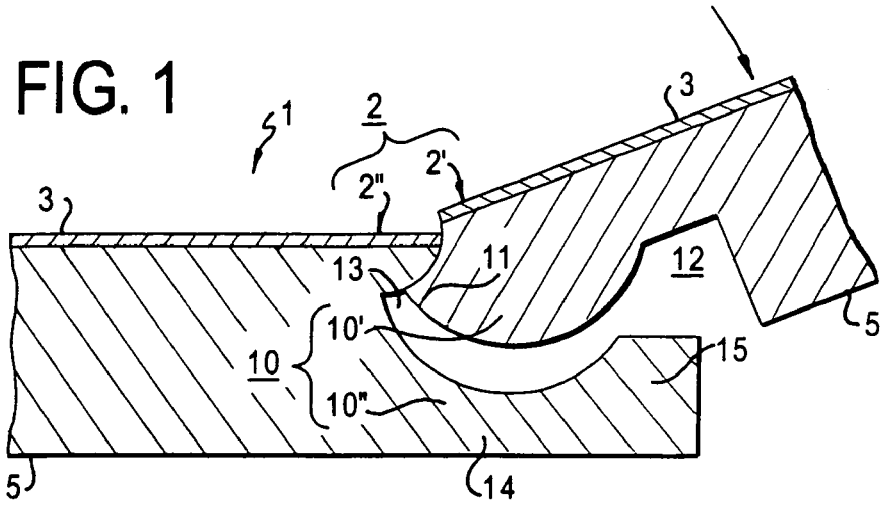
FIG. 1 shows, in cross-section, a first and a second edge $\mathbf{2}^{I}$ and $\mathbf{2}^{II}$ respectively, during joining.

FIG. 1 shows, in cross-section, a first and a second edge $\mathbf{2}^{I}$ and $\mathbf{2}^{II}$ respectively, during assembly. The figure shows parts of a flooring material comprising sheet-shaped floor elements 1 with a mainly square or rectangular shape. The floor elements 1 are provided with edges 2, a lower side 5 and an upper decorative layer 3. The floor elements 1 are intended to be joined by means of joining members 10. Such floors floor elements, for example, be constituted of solid wood, fibre board, such as medium density fibre board (MDF), particle board, chip board, or any other construction comprising pieces or particles of wood, including combinations of plastic elements and the particles or pieces of wood. The floor elements 1 are provided with male joining members 101 on a first edge $\mathbf{2}^{I}$ while a second edge $\mathbf{2}^{II}$ of the floor elements 1 are provided with a female joining member $\mathbf{10}^{II}$. The second edge $\mathbf{2}^{II}$ is arranged on a side opposite to the first edge $\mathbf{2}^{I}$. The male joining member $\mathbf{10}^{I}$ is provided with a tongue 11 and a lower side 5 groove 12. The female joining member $\mathbf{10}^{II}$ is provided with a groove 13 and a cheek 14, the cheek 14 being provided with a lip 15. The floor elements 1 are intended to mainly be joined together by tilting the floor element 1 to be joined with an already installed floor element 1 or a row of already installed floor elements 1, with the male joining member $\mathbf{10}^{I}$ of the floor element 1 angled downwards and that the first edge 21 is allowed to be mainly parallel to the second edge $\mathbf{2}^{II}$ of the already installed floor element 1 or elements 1. The tongue 11 of the tilted floor element 1 is then inserted into the groove 13 of the female joining member $\mathbf{10}^{II}$ of the already installed floor element 1 or elements 1, whereby the tilted floor element 1 is turned downwards, with its lower edge as a pivot axis, so that the lip 15 eventually falls into the lower side 5 groove 12 where the decorative upper layer 3 of the floor elements 1 are mainly parallel.

Figure 2:
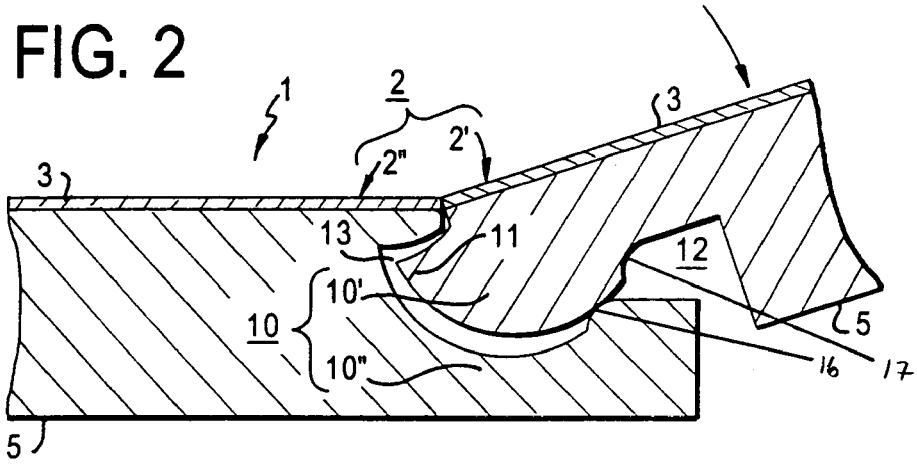
FIG. 2 shows, in cross-section, a second embodiment of a first and a second edge $\mathbf{2}^{I}$ and $\mathbf{2}^{II}$ respectively, during joining.

The embodiment shown in FIG. 2 corresponds mainly with the one shown in FIG. 1. The lip 15 and lower side 5 groove 12 are, however, provided with a cam and a cam groove which provides a snap action locking.

Figure 3:
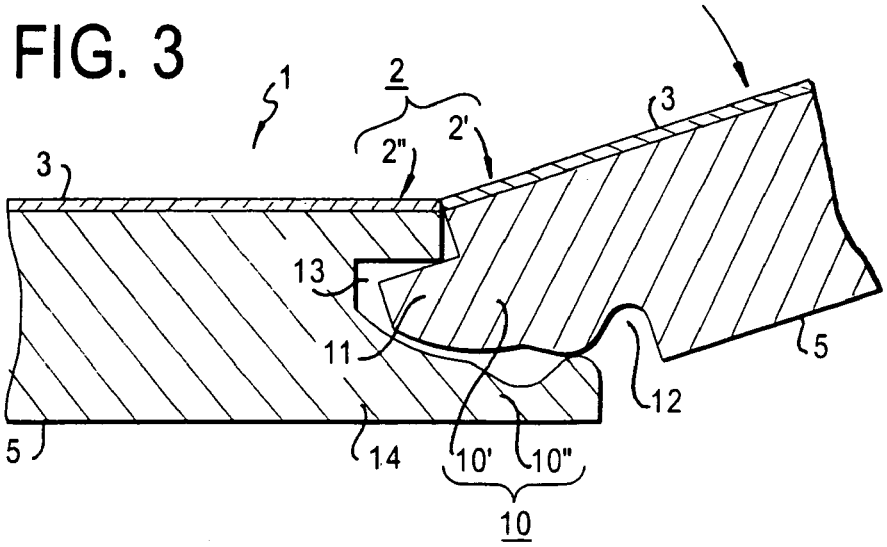
FIG. 3 shows, in cross-section, a third embodiment of a first and a second edge $\mathbf{2}^{I}$ and $\mathbf{2}^{II}$ respectively, during joining.

The embodiment shown in FIG. 3 corresponds mainly with the one shown in FIGS. 1 and 2 above. The lip 15 and lower side 5 groove 12 are, however, provided with a cam and a cam groove which provides a snap action locking.

Figure 4:
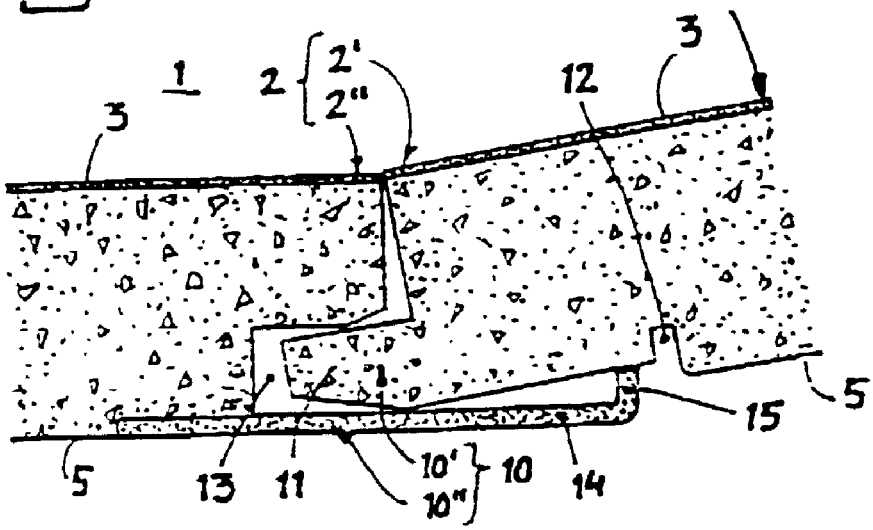
FIG. 4 shows, in cross-section, a fourth embodiment of a first and a second edge $\mathbf{2}^{I}$ and $\mathbf{2}^{II}$ respectively, during joining.

The embodiment shown in FIG. 4 corresponds mainly with the one shown in FIG. 1 above. The lip 15 and cheek 14 is however shaped as a thin resilient section which provides a snap action locking.

Figure 5:
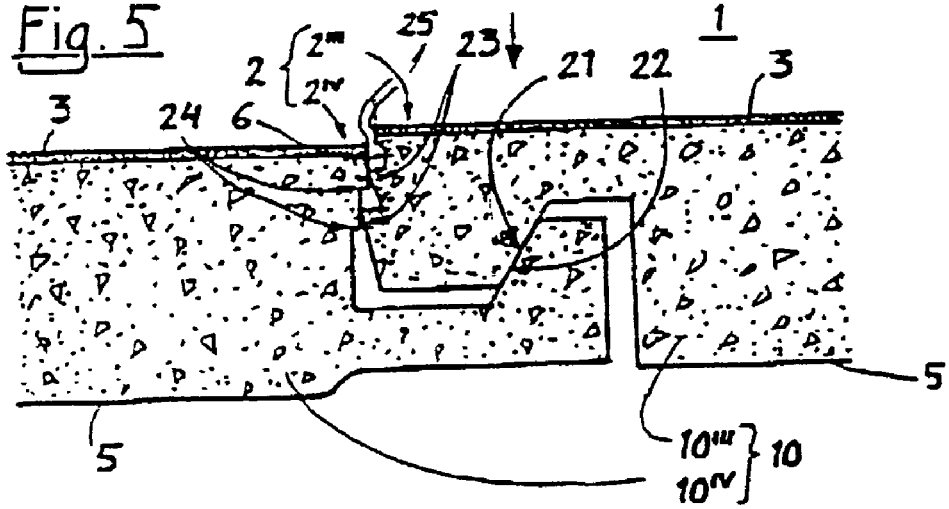
FIG. 5 shows, in cross-section, a third and a fourth edge $\mathbf{2}^{III}$ and $\mathbf{2}^{IV}$ respectively, during joining.

FIG. 5 shows, in cross-section, a third and a fourth edge $\mathbf{2}^{III}$ and $\mathbf{2}^{IV}$ respectively, of a floor element 1 according to any of the FIGS. 1 to 4. The floor elements 1 are provided with a male vertical assembly joining member $\mathbf{10}^{III}$ on a third edge $\mathbf{2}^{III}$ while a fourth edge $\mathbf{2}^{IV}$ is provided with a female vertical assembly joining member $\mathbf{10}^{IV}$. The fourth edge $\mathbf{2}^{IV}$ is placed on a side opposite to the third edge $\mathbf{2}^{III}$. The male vertical assembly joining members $\mathbf{10}^{III}$ are provided with mainly vertical lower cheek surfaces 21 arranged parallel to the closest edge 2. The lower cheek surfaces 21 are intended to interact with mainly vertical upper cheek surfaces 22 arranged on the female vertical assembly joining members $\mathbf{10}^{IV}$ so that two joined adjacent floor elements 1 are locked against each other in a horizontal direction. The male vertical assembly joining members $\mathbf{10}^{III}$ are moreover provided with two snapping hooks 23 while the female vertical assembly joining members $\mathbf{10}^{IV}$ are provided with matching under cuts 24, which by being provided with mainly horizontal locking surfaces limits the vertical movement between two joined adjacent floor elements 1.

The joint between a third and a fourth edge $\mathbf{2}^{III}$ and $\mathbf{2}^{IV}$ respectively of two joined floor elements 1 further comprises contact surfaces which are constituted by the horizontal locking surfaces of the under cuts 24 and hooks 23, the mainly vertical upper cheek surfaces 22 lower cheek surfaces as well as upper mating surfaces 25. The joint between two joined floor elements 1 also comprises cavities 6.

Figure 6:
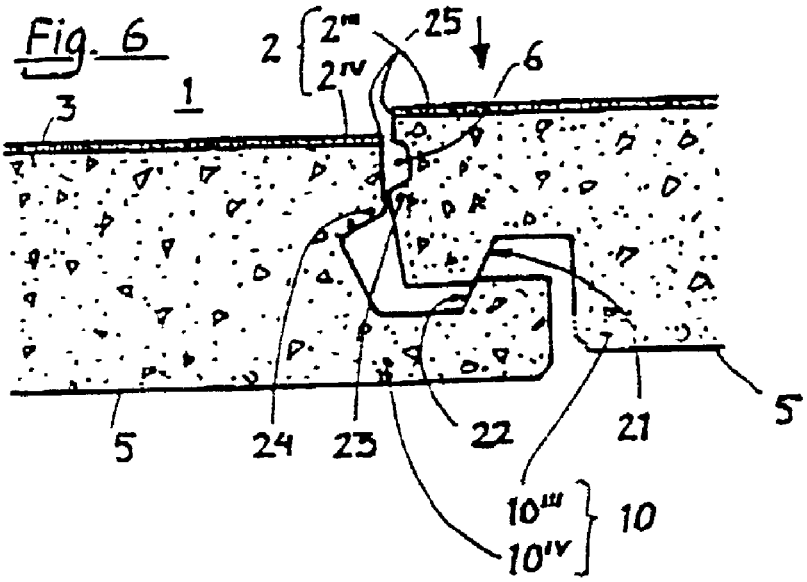
FIG. 6 shows, in cross-section, a second embodiment of a third and a fourth edge $\mathbf{2}^{III}$ and $\mathbf{2}^{IV}$ respectively, during joining.

The embodiment shown in FIG. 6 corresponds in the main with the one shown in FIG. 5. The male vertical assembly joining members $\mathbf{10}^{III}$ are, however, provided with only one snapping hook 23 while the female vertical assembly joining members $\mathbf{10}^{IV}$ are provided with a matching undercut 24, which by being provided with mainly horizontal locking surfaces limits vertical movement between to joined adjacent floor boards 1.

Figure 7:
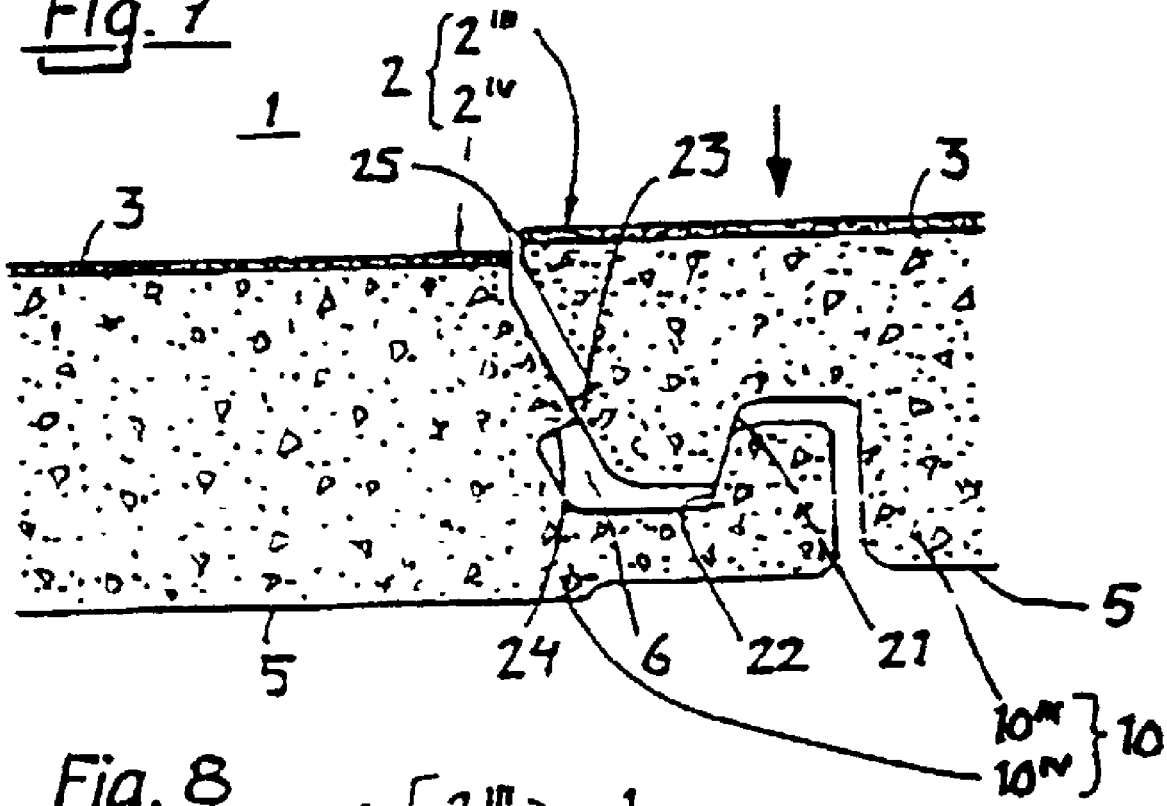
FIG. 7 shows, in cross-section, a third embodiment of a third and a fourth edge $\mathbf{2}^{III}$ and $\mathbf{2}^{IV}$ respectively, during joining.

The embodiment shown in FIG. 7 corresponds in the main with the one shown in FIG. 6. The snapping hook 23 on the male vertical assembly joining member $\mathbf{10}^{III}$ is, however, moved somewhat inwards in the floor element 1 whereby a guiding angle is formed above the undercut 24 of the female vertical joining member $\mathbf{10}^{IV}$.

Figure 8:
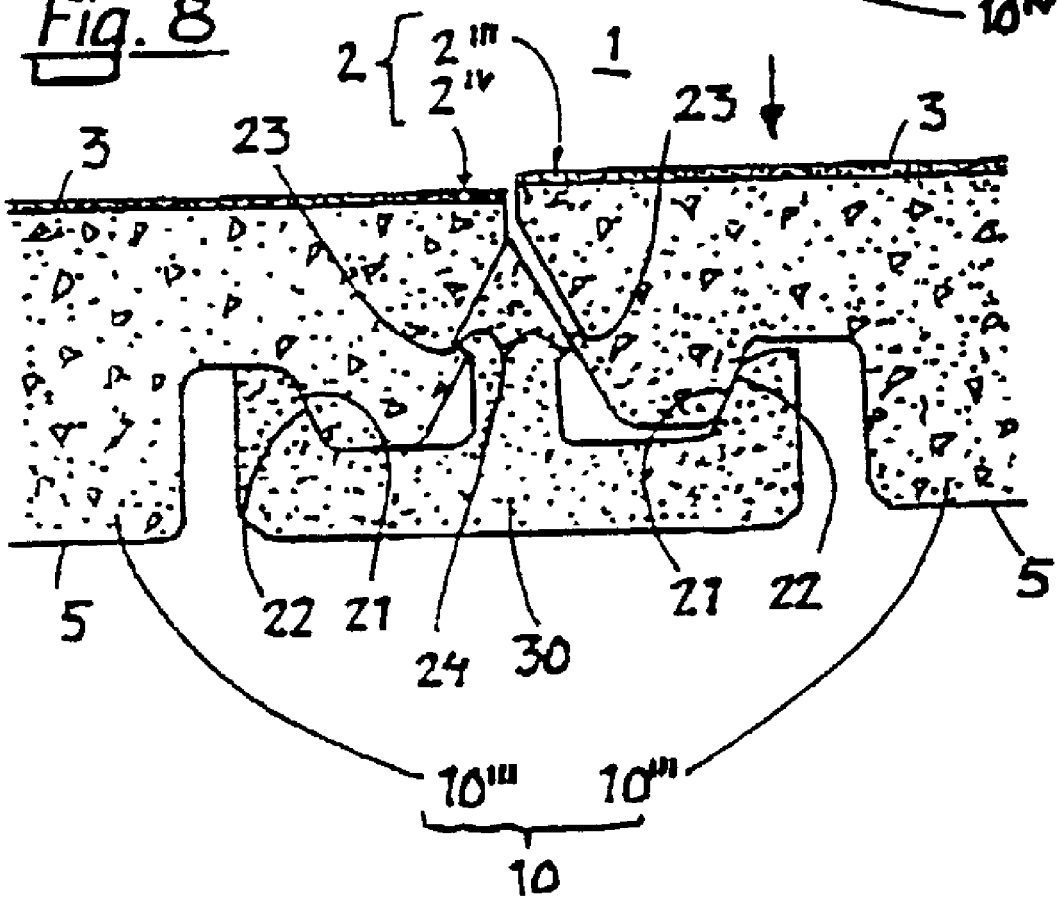
FIG. 8 shows, in cross-section, a fourth embodiment of a third and a fourth edge $\mathbf{2}^{III}$ and $\mathbf{2}^{IV}$ respectively and a vertical assembly joining profile 30, during joining.

The embodiment shown in FIG. 8 corresponds mainly with the one shown in FIG. 7. Both the third and the fourth edges $\mathbf{2}^{III}$ and $\mathbf{2}^{IV}$ respectively are, however, provided with male vertical assembly joining members $\mathbf{10}^{III}$. A vertical assembly joining profile 30, provided with a female vertical assembly joining profile $\mathbf{10}^{IV}$ on both sides of a vertical symmetry line, is used for joining the two floor elements 1. The female vertical assembly joining members $\mathbf{10}^{IV}$ of the vertical assembly joining profile 30 are equipped similar to the female vertical assembly joining members $\mathbf{10}^{IV}$ in FIG. 7 above.

Two adjacent edges 2 of a floor element 1 can at the same time, and in the same turning motion, be joined with a floor element 1 adjacent to the first edge 21 and a floor element 1 adjacent to the third or fourth edge $\mathbf{2}^{III}$ and $\mathbf{2}^{IV}$ respectively, when assembling floor elements 1 according to the above described embodiments.

The floor elements 1 according to the present invention most often comprises a core. The core is most often comprised of particles or fibre of wood bonded with resin or glue. It is advantageous to coat the surface closest to the joint in cases where the floor will be exposed to high levels of moisture since the cellulose based material is sensitive to moisture. This coating may suitably incorporate resin, wax or some kind of lacquer. It is not necessary to coat the joint when it is to be glued since the glue itself will protect from moisture penetration. The upper decorative layer 3 is constituted of a decorative paper impregnated with melamine-formaldehyde resin. One or more so called overlay sheets of a-cellulose, impregnated with melamine-formaldehyde resin may possibly be placed on top of the decorative layer. The abrasion resistance may be improved by sprinkling one or more of the sheets with hard particles of for example α-aluminium oxide, silicon carbide or silicon oxide. The lower side 5 may suitably be coated with lacquer or a layer of paper and resin.

FIGS. 13–16 demonstrate the improvement of the invention, particularly to the radially projected dimension of the length of the groove or the projected dimension of the length of the undercut and the horizontal rotated radially projected height of the lip or the horizontal rotated radially projected height of the upper cheek surface of the boards of the invention. In contrast to FIGS. 9–12, show the radially projected dimension, indicated at $\alpha$, corresponds to the length of the groove 13, while $\beta$ indicates the horizontal rotated length of lip 15. Additionally, $\gamma$ indicates the length of the tongue 11, while $\delta$ is the horizontal rotated length of the locking groove 12. Because $\alpha$ is greater than $\gamma$, and $\beta$ is greater than $\delta$, adjacent floor elements cannot be assembled horizontally. In other words, because the size of the tongue 11 (as well as groove 13) is greater than the size of lip 15 (as well as locking groove 12), the floor elements depicted in these figures can only be assembled by rotating or turning one of the floor elements with respect to the other floor elements. Generally, in each of these figures, $\alpha$ is substantially equal to $\gamma$ and $\beta$ is substantially equal to $\delta$. This "substantially equal" relationship provides for a close fitting, while limiting movement of adjacent panels once assembled. For example, the difference in dimensions may be from 0.005–5%, or from 0.02–0.5 mm.

In contrast, the floor elements shown in FIGS. 13–16 may be assembled through vertical motion. Specifically, $\epsilon$ is the length of the undercut 24, while $\zeta$ corresponds to the horizontal rotated length of the upper cheek surface 22. Additionally, $\eta$ indicates the length of the snapping hooks 23, while the horizontal rotated length of the lower cheek surface 21 is specified by $\theta$. Because $\epsilon$ is less than $\zeta$ and $\eta$ is less than $\theta$, the floor elements can be assembled through vertical movement. That is to say, due to the particular dimensions of the undercuts 24, upper cheek surface 22, snapping hooks 23 and lower cheek surface 21, the floor panels of this embodiment of the invention may be joined through substantially vertical movement of one panel with respect to a second panel.

The dimensions $\epsilon$ and $\eta$ may also be related to the thickness of the floor element itself. For example, the ratio between $\epsilon$ and the thickness (or $\eta$ and the surface) may be in the range of about 0.025 to 0.2, typically, about 0.05 to about 0.1, and more typically, about 0.07 to 0.09. That is to say, when the thickness is 8 mm, as is common in conventional boards, $\epsilon$ or $\eta$ would be from 0.2 to 1.5 mm. Additionally, $\alpha$ (or $\gamma$) can be at least 2 times greater than $\beta$ (or $\delta$), while $\epsilon$ (or $\eta$) is at least 2 times $\zeta$ (or $\theta$).

Figure 9:
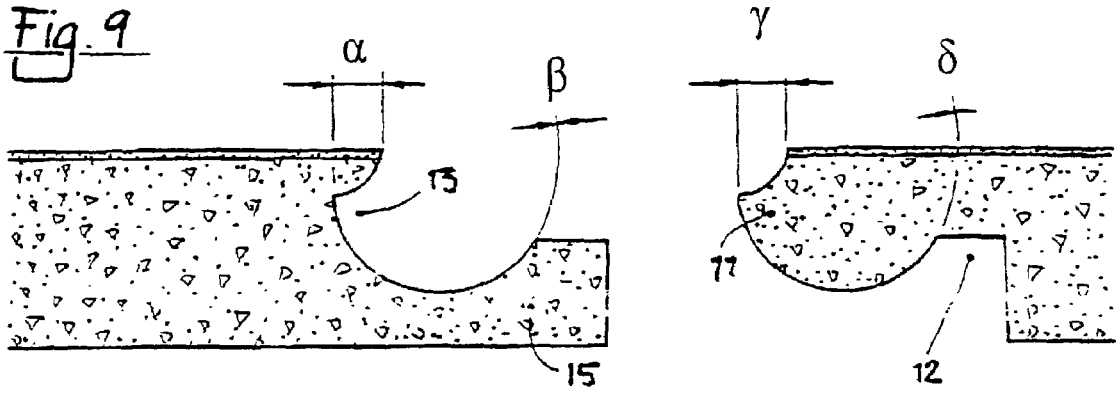
FIG. 9 shows, in cross-section, a first and a second edge $\mathbf{2}^{I}$ and $\mathbf{2}^{II}$ respectively, during joining.
Figure 10:
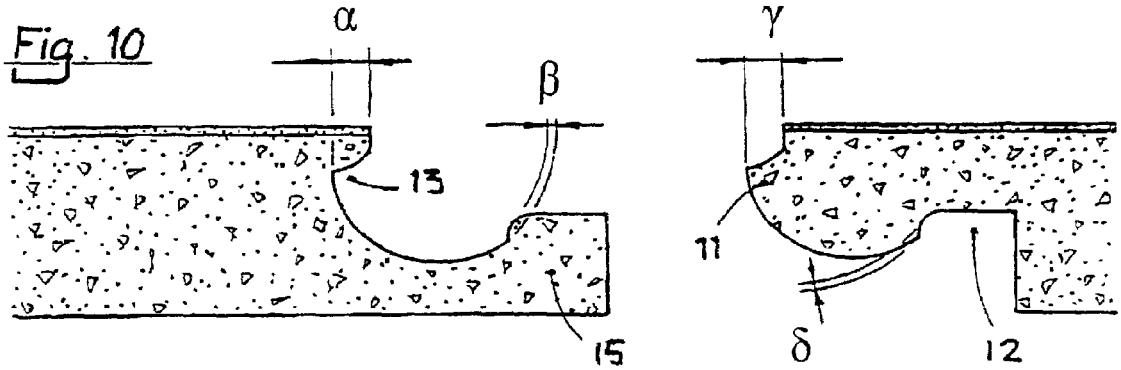
FIG. 10 shows, in cross-section, a second embodiment of a first and a second edge $\mathbf{2}^{I}$ and $\mathbf{2}^{II}$ respectively, during joining.
Figure 11:
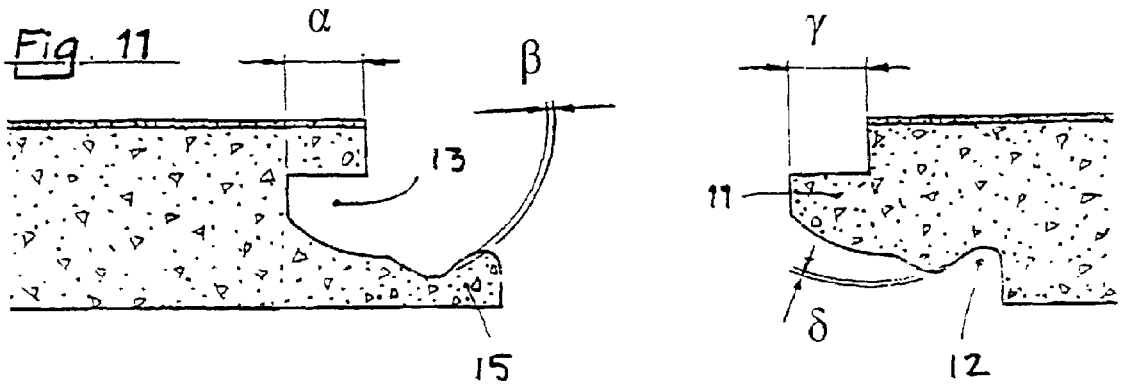
FIG. 11 shows, in cross-section, a third embodiment of a first and a second edge $\mathbf{2}^{I}$ and $\mathbf{2}^{II}$ respectively, during joining.
Figure 12:
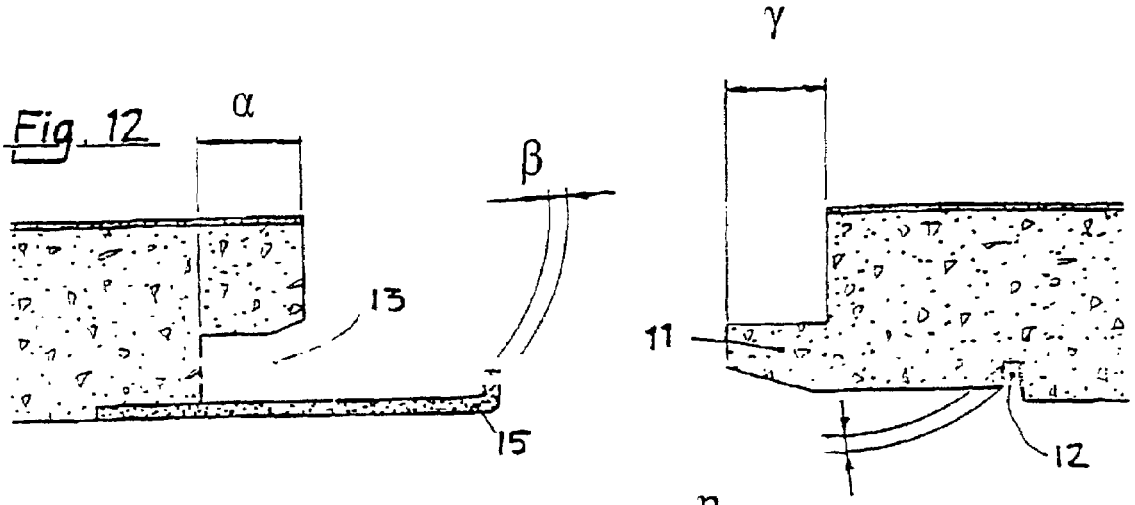
FIG. 12 shows, in cross-section, a fourth embodiment of a first and a second edge $\mathbf{2}^{I}$ and $\mathbf{2}^{II}$ respectively, during joining.
Figure 13:
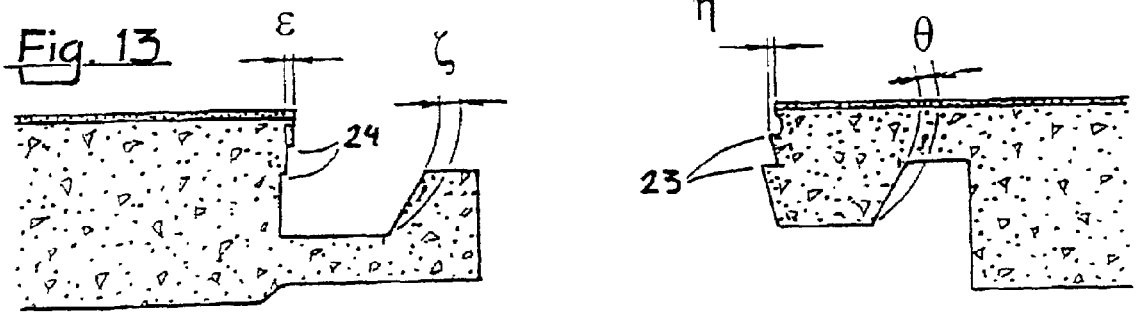
FIG. 13 shows, in cross-section, a third and a fourth edge $\mathbf{2}^{III}$ and $\mathbf{2}^{IV}$ respectively, during joining.
Figure 14:
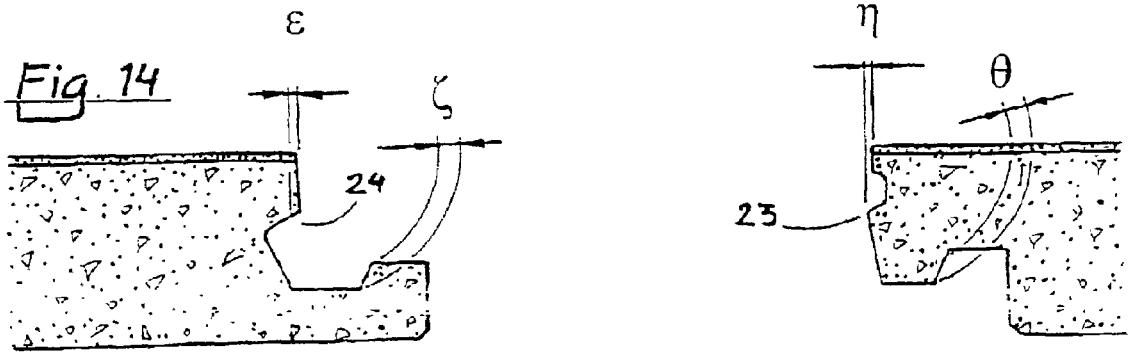
FIG. 14 shows, in cross-section, a second embodiment of a third and a fourth edge $\mathbf{2}^{III}$ and $\mathbf{2}^{IV}$ respectively, during joining.
Figure 15:
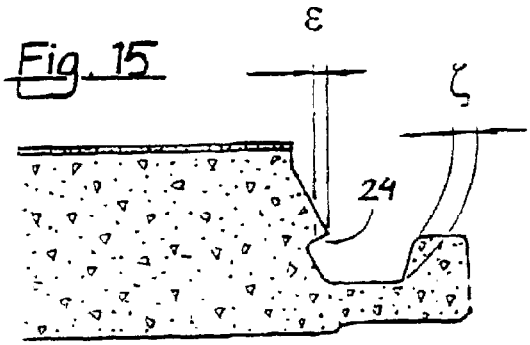
FIG. 15 shows, in cross-section, a third embodiment of a third and a fourth edge $\mathbf{2}^{III}$ and $\mathbf{2}^{IV}$ respectively, during joining.
Figure 15:
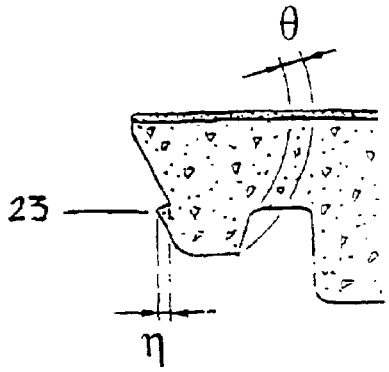
Figure 16:
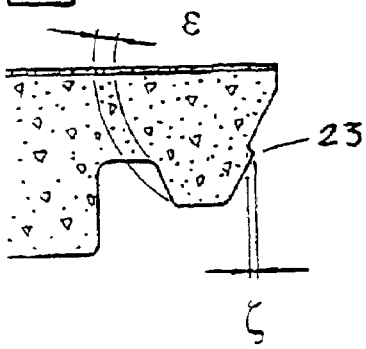
FIG. 16 shows, in cross-section, a fourth embodiment of a third and a fourth edge $\mathbf{2}^{III}$ and $\mathbf{2}^{IV}$ respectively and a vertical assembly joining profile 30, during joining.
Figure 16:
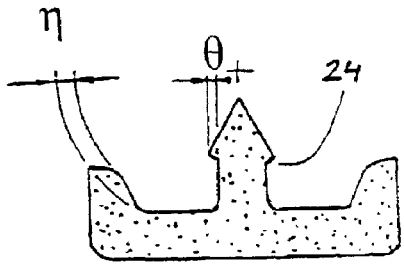

Moreover, all dimension lines of FIGS. 9–16 are intended to indicate the area taken up by the inserted part as the recesses, such as, the groove 13 and need not be deeper than the tongue 11. Although in some cases, the recesses are deeper than the length of the tongue 11. With particular reference to FIG. 9, $\beta$ effectively is zero, meaning that there is no undercut when pivoting the panel.

Additionally, a substantially planar floor element having at least a first edge and a second edge, a lower side and an upper decorative layer, said first edge comprising an undercut and an upper cheek surface at least partially defining said tongue, said second edge comprising at least one snapping hook and a lower cheek surface, wherein a radially projected length (L) of the undercut is less than or equal to a horizontal rotated radially projected height (H) of the upper cheek surface such that when said first edge is mated to a corresponding second edge on an adjacent floor element through substantially vertical motion, said undercut on said floor element unites with the snapping hook on the adjacent floor element and said upper cheek surface unites with the lower cheek surface of the adjacent floor element to prohibit separation of the floor element and the adjacent floor element. The size and shape of each of said undercut, upper cheek surface, at least one snapping hook and lower cheek surface can be designed to require mating by only vertical motion.

In other embodiments, a substantially planar floor element having at least a first edge and a second edge, a lower side and an upper decorative layer, said first edge comprising an undercut and an upper cheek surface at least partially defining said tongue, said second edge comprising at least one snapping hook and a lower cheek surface, wherein the radially projected length (L) of the snapping hooks ($\eta$) is less than or equal to the horizontally rotated projected height (H) of the lower cheek surface ($\theta$) such that when said first edge is mated to a corresponding second edge on an adjacent floor element through substantially vertical motion, said undercut on said floor element unites with the snapping hook on the adjacent floor element and said upper cheek surface unites with the lower cheek surface of the adjacent floor element to prohibit separation of the floor element and the adjacent floor element. The length (L') of the undercut ($\epsilon$) can also be less than or equal to the horizontal rotated projected height (H') of the upper cheek surface ($\zeta$). The thickness of the floor element may also be 8 mm and H may be from 0.2 to 1.5 mm. Finally, L' indicates the length of the undercut.

Finally, the floor elements of this invention, preferably, comprise vertically-joined edges on at least two sides. For example, when the floor panel has a substantially rectangular shape, such vertically-joined edges may be found on two, three or all four sides. When the vertically-joined edges are located on less than all sides of the floor element, the remaining sides may include, for example, edges joined by rotating or horizontal movement or simple straight edges without a joining profile.

The invention is not limited by the embodiments shown since they can be varied within the scope if the invention.

The invention claimed is:

1. A substantially planar floor element having at least a first edge and a second edge, a lower side and an upper decorative layer, said first edge comprising an undercut and an upper cheek surface at least partially defining a tongue, said second edge comprising at least one snapping hook and a lower cheek surface, wherein a radially projected length (L) of the undercut is less than or equal to a horizontal rotated radially projected height (H) of the upper cheek surface such that when said first edge is mated to a corresponding second edge on an adjacent floor element through substantially vertical motion, said undercut on said floor element unites with the snapping hook on the adjacent floor element and said upper cheek surface unites with the lower cheek surface of the adjacent floor element to prohibit at least vertical separation of the floor element and the adjacent floor element, wherein the size and shape of each of said undercut, upper cheek surface, at least one snapping hook and lower cheek surface requires mating by only vertical motion.

2. The floor element of claim 1, wherein said undercut has a length smaller than the horizontal height of said upper cheek surface.

3. The floor element of claim 2, wherein said snapping hook has a length smaller than a horizontal length of said lower cheek surface.

4. The floor element of claim 1, wherein said snapping hook has a length smaller than the horizontal height of said lower cheek surface.

5. The floor element of claim 1, wherein the force of static friction along the joint between the floor element and the adjacent floor element is larger than 10N per meter of joint length.

6. The floor element of claim 1, further comprising at least a third edge and a fourth edge, wherein each of said third edge and said fourth edge are mated to corresponding edges on adjacent floor elements through motion other than solely vertical motion.

7. A substantially planar floor element having at least a first edge and a second edge, a lower side and an upper decorative layer, said first edge comprising an undercut and an upper cheek surface at least partially defining a tongue, said second edge comprising at least one snapping hook and a lower cheek surface, wherein a radially projected length (L) of the undercut is less than or equal to a horizontal rotated radially projected height (H) of the upper cheek surface such that when said first edge is mated to a corresponding second edge on an adjacent floor element through substantially vertical motion, said undercut on said floor element unites with the snapping hook on the adjacent floor element and said upper cheek surface unites with the lower cheek surface of the adjacent floor element to prohibit at least vertical separation of the floor element and the adjacent floor element, wherein said undercut has a length smaller than the horizontal height of said upper cheek surface.

8. The floor element of claim 7, wherein said snapping hook has a length smaller than the horizontal height of said lower cheek surface.

9. A substantially planar floor element having at least a first edge and a second edge, a lower side and an upper decorative layer, said first edge comprising an undercut and an upper cheek surface at least partially defining a tongue, said second edge comprising at least one snapping hook and a lower cheek surface, wherein a radially projected length (L) of the undercut is less than or equal to a horizontal rotated radially projected height (H) of the upper cheek surface such that when said first edge is mated to a corresponding second edge on an adjacent floor element through substantially vertical motion, said undercut on said floor element unites with the snapping hook on the adjacent floor element and said upper cheek surface unites with the lower cheek surface of the adjacent floor element to prohibit at least vertical separation of the floor element and the adjacent floor element, wherein said snapping hook has a length smaller than the horizontal height of said lower cheek surface.

10. A method of forming a floor comprising: providing a first floor element comprising at least one edge, the edge comprising an undercut and an upper cheek surface; providing a second floor element comprising at least one edge, the edge comprising at least one snapping hook and a lower cheek surface; and mating the first floor element with the second floor element by moving the second floor element in a vertical direction with respect to the first floor element, wherein said mating comprises joining the undercut of the first floor element with the snapping hook of the second floor element to limit relative vertical movement between the first floor element and the second floor element, wherein said mating consists of moving the second floor element in a vertical direction with respect to the first floor element.

11. The method of claim 10, wherein said mating comprises joining the upper cheek surface of the first floor element with the lower cheek surface of the second floor element.

12. A substantially planar floor element having at least a first edge and a second edge, a lower side and an upper decorative layer, said first edge comprising an undercut and an upper cheek surface at least partially defining a tongue, said second edge comprising at least one snapping hook and a lower cheek surface, wherein the radially projected length of the snapping hooks ($\eta$) is less than or equal to the horizontally rotated projected height of the lower cheek surface ($\theta$) such that when said first edge is mated to a corresponding second edge on an adjacent floor element through substantially vertical motion, said undercut on said floor element unites with the snapping hook on the adjacent floor element and said upper cheek surface unites with the lower cheek surface of the adjacent floor element to prohibit at least vertical separation of the floor element and the adjacent floor element, wherein the size and shape of each of said undercut, upper cheek surface, at least one snapping hook and lower cheek surface requires mating only by vertical motion.

13. The floor element of claim 12, wherein the length of the undercut ($\epsilon$) is less than or equal to the horizontal rotated projected height of the upper cheek surface ($\zeta$).

14. The floor element of claim 12, wherein $\eta$, is substantially equal to $\epsilon$ and $\theta$ is substantially equal to $\zeta$.

15. The floor element of claim 12, wherein the ratio between $\theta$ and the thickness of the floor element is in the range of about 0.025 to 0.2.

16. The floor element of claim 15, wherein the thickness of the floor element is 8 mm and H is from 0.2 to 1.5 mm.

* * * * *